US012391456B2

(12) United States Patent
Tye

(10) Patent No.: US 12,391,456 B2
(45) Date of Patent: Aug. 19, 2025

(54) CONTAINER WITH LINER

(71) Applicant: Graphic Packaging International, LLC, Atlanta, GA (US)

(72) Inventor: Paul Tye, Buckinghamshire (GB)

(73) Assignee: Graphic Packaging International, LLC, Atlanta, GA (US)

( * ) Notice: Subject to any disclaimer, the term of this patent is extended or adjusted under 35 U.S.C. 154(b) by 575 days.

(21) Appl. No.: 16/037,425

(22) Filed: Jul. 17, 2018

(65) Prior Publication Data

US 2018/0319568 A1 Nov. 8, 2018

Related U.S. Application Data

(63) Continuation-in-part of application No. 15/654,814, filed on Jul. 20, 2017, now Pat. No. 11,358,779.

(Continued)

(51) Int. Cl.
*B65D 81/34* (2006.01)
*B65D 5/20* (2006.01)

(Continued)

(52) U.S. Cl.
CPC ..... *B65D 81/3453* (2013.01); *B65D 5/209* (2013.01); *B65D 5/48002* (2013.01); *B65D 5/563* (2013.01); *B65D 7/08* (2013.01); *B65D 7/26* (2013.01); *B65D 77/042* (2013.01); *B65D 77/286* (2013.01); *B65D 2581/055* (2013.01); *B65D 2581/347* (2013.01); *B65D 2581/3472* (2013.01); *B65D 2581/3479* (2013.01);

(Continued)

(58) Field of Classification Search
CPC .... B65D 81/3453; B65D 5/209; B65D 5/563; B65D 7/08; B65D 7/26; B65D 77/0413; B65D 77/22; B65D 2581/055; B65D 2581/347; B65D 2581/3472; B65D 2581/3479; B65D 5/2033; B65D 5/2047; B65D 5/242; B65D 5/243
USPC ..... 206/557; 229/407
See application file for complete search history.

(56) References Cited

U.S. PATENT DOCUMENTS 2,110,681 A 3/1938 Rutledge
3,104,012 A * 9/1963 Beamish ..... B65D 77/22 206/438

(Continued)

FOREIGN PATENT DOCUMENTS

CA 2 814 149 A1 4/2012
CN 203450620 U 2/2014

(Continued)

OTHER PUBLICATIONS

International Search Report and Written Opinion for PCT/US2017/042979 dated Sep. 22, 2017.

(Continued)

*Primary Examiner* — Andrew D Perreault
(74) *Attorney, Agent, or Firm* — Womble Bond Dickinson (US) LLP

(57) ABSTRACT

A container for heating a food product. The container comprises a base layer of material and a liner releasably attached to an inner surface of the base layer. The liner is at least partially attached to the base layer by a heat seal layer, and the liner is separable from the base layer after heating the container. The container comprises a bottom panel and a sidewall extending along the bottom panel.

38 Claims, 10 Drawing Sheets

Related U.S. Application Data

(60) Provisional application No. 62/649,159, filed on Mar. 28, 2018, provisional application No. 62/643,914, filed on Mar. 16, 2018, provisional application No. 62/365,635, filed on Jul. 22, 2016.

(51) Int. Cl.

| | |
|---|---|
| ***B65D 5/48*** | (2006.01) |
| ***B65D 5/56*** | (2006.01) |
| ***B65D 6/04*** | (2006.01) |
| ***B65D 6/18*** | (2006.01) |
| ***B65D 77/04*** | (2006.01) |
| ***B65D 77/28*** | (2006.01) |

(52) U.S. Cl.

CPC ..... *B65D 2581/3491* (2013.01); *B65D 2581/3493* (2013.01)

(56) References Cited

U.S. PATENT DOCUMENTS

| | | | |
|---|---|---|---|
| 3,154,215 | A | 10/1964 | Le Vesconte |
| 3,358,900 | A | 12/1967 | Perdue et al. |
| 3,489,331 | A | 1/1970 | Anderson et al. |
| 3,575,338 | A | 4/1971 | Dilot |
| 3,640,188 | A | 2/1972 | Dilot |
| 3,893,882 | A | 7/1975 | Repenning |
| 3,941,301 | A | 3/1976 | Jorgensen |
| 4,046,310 | A | 9/1977 | Gustafsson |
| 4,057,380 | A | 11/1977 | Hosoe |
| 4,130,236 | A | 12/1978 | Manizza |
| 4,283,427 | A | 8/1981 | Winters et al. |
| 4,305,542 | A | 12/1981 | Benzschawel et al. |
| 4,308,895 | A | 1/1982 | Manizza |
| 4,325,905 | A | 4/1982 | Takahashi |
| 4,351,473 | A | 9/1982 | Manizza |
| 4,533,065 | A | 8/1985 | Chazal et al. |
| 4,555,381 | A | 11/1985 | Chazal et al. |
| 4,718,596 | A | 1/1988 | Muller et al. |
| 4,943,456 | A | 7/1990 | Pollart et al. |
| 5,000,374 | A | 3/1991 | Deiger |
| 5,002,826 | A | 3/1991 | Pollart et al. |
| 5,002,833 | A | 3/1991 | Kinsey, Jr. et al. |
| 5,118,747 | A | 6/1992 | Pollart et al. |
| 5,203,491 | A | 4/1993 | Marx et al. |
| 5,253,801 | A | 10/1993 | Bernstein et al. |
| 5,326,021 | A | 7/1994 | Farrell |
| 5,351,879 | A | 10/1994 | Liu |
| 5,410,135 | A | 4/1995 | Pollart et al. |
| 5,412,187 | A | 5/1995 | Walters et al. |
| 5,530,231 | A | 6/1996 | Walters et al. |
| 5,533,622 | A * | 7/1996 | Stockley, III ..... B65B 9/02 206/484 |
| 5,533,623 | A | 7/1996 | Fischer |
| 5,647,168 | A | 7/1997 | Gilbert |
| 6,092,687 | A | 7/2000 | Hupp et al. |
| 6,116,501 | A | 9/2000 | Hupp |
| 6,204,492 | B1 | 3/2001 | Zeng et al. |
| 6,234,386 | B1 | 5/2001 | Drummond et al. |
| 6,433,322 | B2 | 8/2002 | Zeng et al. |
| 6,552,315 | B2 | 4/2003 | Zeng et al. |
| 6,677,563 | B2 | 1/2004 | Lai |
| 8,534,460 | B2 | 9/2013 | Wnek et al. |
| 8,801,995 | B2 | 8/2014 | Wnek et al. |
| 9,783,345 | B2 | 10/2017 | Bentham |
| 2005/0031814 | A1 | 2/2005 | Dawes |
| 2007/0116806 | A1 | 5/2007 | Parsons |
| 2008/0035634 | A1 | 2/2008 | Zeng et al. |
| 2011/0174676 | A1 | 7/2011 | Stockhaus |
| 2011/0259784 | A1 | 10/2011 | Tye et al. |
| 2012/0248180 | A1 | 10/2012 | White et al. |
| 2013/0327821 | A1 | 12/2013 | Zwaga et al. |
| 2014/0183198 | A1 | 7/2014 | Slack |
| 2014/0224866 | A1 | 8/2014 | Littlejohn et al. |
| 2015/0225120 | A1 | 8/2015 | Wnek et al. |
| 2017/0341355 | A1 | 11/2017 | Peiffer et al. |
| 2018/0022529 | A1 | 1/2018 | Tye |
| 2020/0047940 | A1 | 2/2020 | Tye et al. |
| 2020/0047975 | A1 | 2/2020 | Tye et al. |
| 2020/0255200 | A1 | 8/2020 | Mondini et al. |

FOREIGN PATENT DOCUMENTS

| | | | |
|---|---|---|---|
| DE | 100 22 552 | | 11/2001 |
| EP | 0 671 332 | A1 | 9/1995 |
| EP | 1 104 744 | A2 | 6/2001 |
| FR | 2133727 | | 12/1972 |
| FR | 2406522 | | 5/1979 |
| FR | 2826938 | | 1/2003 |
| FR | 2933329 | | 1/2010 |
| GB | 1 314 148 | | 4/1973 |
| GB | 1 501 764 | | 2/1978 |
| GB | 1 602 625 | | 11/1981 |
| GB | 2 487 765 | A | 8/2012 |
| GB | 2 550 386 | A | 11/2017 |
| JP | 2000-141511 | | 5/2000 |
| JP | 2001 278246 | A | 10/2001 |
| JP | 2002 347746 | A | 12/2002 |
| KR | 10-1539187 | B1 | 7/2015 |
| TW | M 295475 | U | 8/2006 |
| TW | M 301016 | U | 11/2006 |
| WO | WO 2003/041945 | | 5/2003 |
| WO | WO 2007/127371 | | 11/2007 |
| WO | WO 2009/138786 | | 11/2009 |
| WO | WO 2012/049005 | | 4/2012 |
| WO | WO 2013/002639 | | 1/2013 |
| WO | WO 2014/032059 | A1 | 2/2014 |
| WO | WO 2014/066867 | A1 | 5/2014 |
| WO | WO 2015/009518 | | 1/2015 |
| WO | WO 2019/094057 | A1 | 5/2016 |
| WO | WO 2018/017783 | A1 | 1/2018 |
| WO | WO 2018/178508 | A1 | 10/2018 |
| WO | WO 2019/020863 | | 1/2019 |
| WO | WO 2019/092323 | A1 | 5/2019 |
| WO | WO 2020/033350 | | 2/2020 |
| WO | WO 2020/033352 | | 2/2020 |

OTHER PUBLICATIONS

International Search Report and Written Opinion for PCT/US2018/042431 dated Dec. 14, 2018.

Supplementary European Search Report for EP 17 83 1847 dated January.

Office Action for Canadian Patent Application No. 3,027,438 dated Nov. 7, 2019.

Supplementary European Search Report for EP 18 90 9768 dated Oct. 28, 2021.

* cited by examiner

CONTAINER WITH LINER

CROSS-REFERENCE TO RELATED APPLICATIONS

This application is a continuation-in-part of U.S. patent application Ser. No. 15/654,814, filed on Jul. 20, 2017, which claims the benefit of U.S. Provisional Patent Application No. 62/365,635, filed Jul. 22, 2016. This application claims the benefit of U.S. Provisional Patent Application No. 62/649,159, filed on Mar. 28, 2018, and U.S. Provisional Patent Application No. 62/643,914, filed Mar. 16, 2018.

INCORPORATION BY REFERENCE

The disclosures of U.S. Provisional Patent Application No. 62/649,159, filed Mar. 28, 2018, U.S. Provisional Patent Application No. 62/643,914, filed Mar. 16, 2018, U.S. patent application Ser. No. 15/654,814, filed Jul. 20, 2017, U.S. Provisional Patent Application No. 62/365,635, filed Jul. 22, 2016, and U.S. patent application Ser. No. 12/992,131, filed Feb. 11, 2011, are hereby incorporated by reference for all purposes as if presented herein in their entirety.

BACKGROUND OF THE DISCLOSURE

The present disclosure relates to blanks, containers, trays, constructs, and various features and methods for forming a container from a blank. More specifically, the disclosure is generally directed to a container having a liner, the container being suitable for heating a food product.

SUMMARY OF THE DISCLOSURE

In general, one aspect of the disclosure is generally directed to a container for heating a food product. The container comprises a base layer of material and a liner releasably attached to an inner surface of the base layer. The liner is at least partially attached to the base layer by a heat seal layer, and the liner is separable from the base layer after heating the container. The container comprises a bottom panel and a sidewall extending along the bottom panel.

In another aspect, the disclosure is generally directed to a method of forming a container comprising a bottom panel and a sidewall extending along the bottom panel. The method can comprise obtaining a blank, a liner material, and a heat seal layer, forming the blank into an initial construct, activating the heat seal layer, and applying at least a portion of the liner material to an inner surface of the initial construct so that the liner material and the initial construct form a respective liner and base layer of the container and so that the liner is releasably attached to the inner surface of the base layer by the heat seal layer. The liner can be separable from the base layer after heating the container.

In another aspect, the disclosure is generally directed to a container for heating a food product. The container can comprise a base layer of material and a liner releasably attached to an inner surface of the base layer. The liner can be separable from the base layer after heating the container. The container further can comprise a bottom panel and a sidewall. The sidewall can comprise at least an end panel foldably connected to the bottom panel and a side panel foldably connected to the bottom panel. The sidewall can comprise a lower portion extending along the bottom panel and an upper portion extending upwardly from the lower portion along an intermediate fold line.

In another aspect, the disclosure is generally directed to, in combination, a blank and a liner material for forming a container for heating a food product. The blank can comprise a bottom panel, an end panel foldably connected to the bottom panel, and a side panel foldably connected to the bottom panel. The end panel and the side panel can be for at least partially forming a sidewall comprising a lower portion extending along the bottom panel and an upper portion extending upwardly from the lower portion along an intermediate fold line when the container is formed from the blank and the liner material. The blank can be for forming a base layer of the container. The liner material can be for forming a liner that is releasably attached to an inner surface of the base layer when the container is formed from the blank and the liner material. The liner can be separable from the base layer after heating of the container formed from the blank and the liner material.

In another aspect, the disclosure is generally directed to a method of forming a container. The method can comprise obtaining a blank and a liner material, the blank comprising a bottom panel, an end panel foldably connected to the bottom panel, and a side panel foldably connected to the bottom panel. The method further can comprise forming the blank into an initial construct and attaching at least a portion of the liner material to an inner surface of the initial construct so that the liner material and the initial construct form a respective liner and base layer of the container and so that the liner is releasably attached to the inner surface of the base layer by the heat seal layer. The liner can be separable from the base layer after heating the container. The end panel and the side panel can at least partially form a sidewall comprising a lower portion extending along the bottom panel and an upper portion extending upwardly from the lower portion along an intermediate fold line.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figure 1:
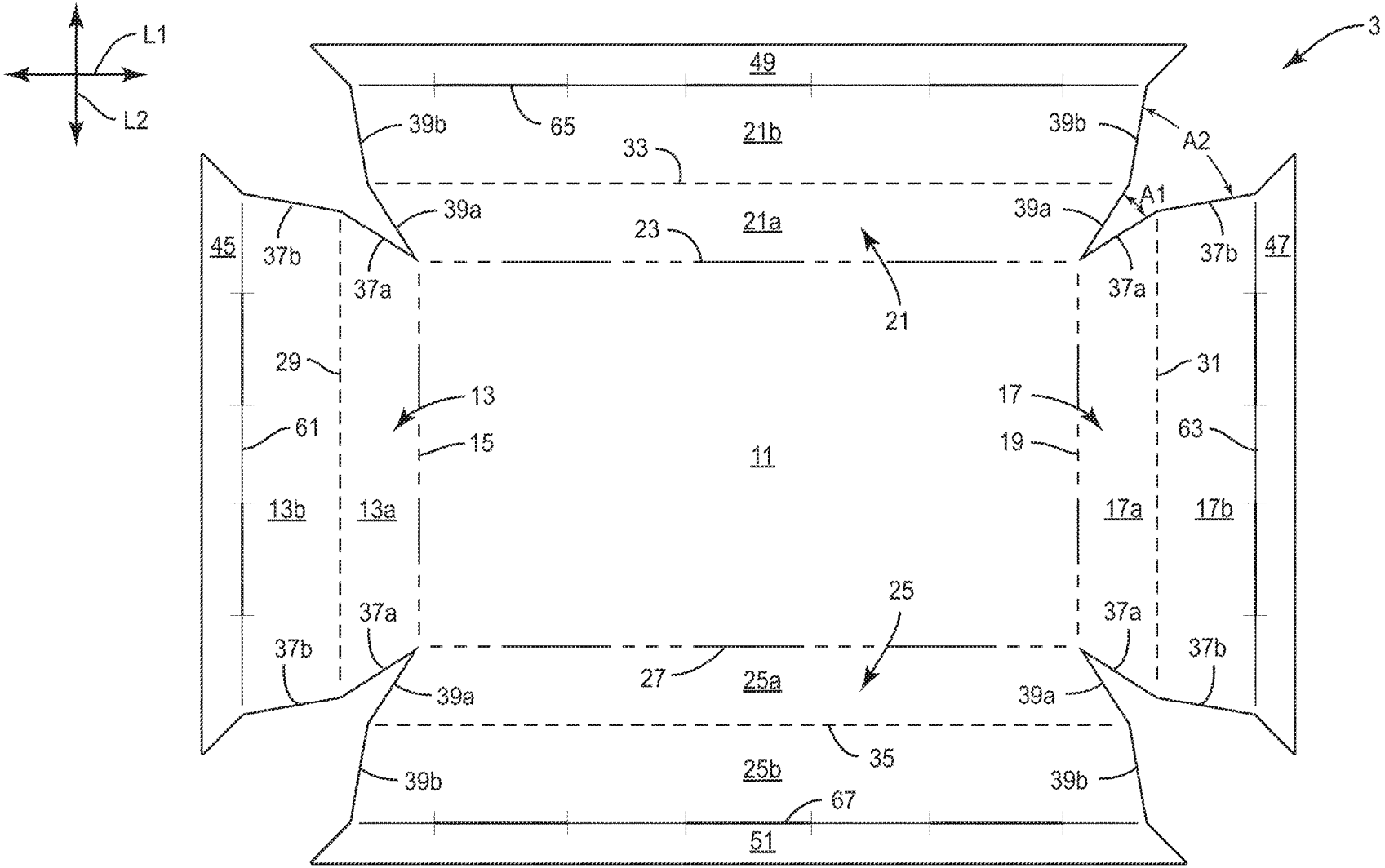
FIG. 1 is a plan view of a blank used for forming a container according to a first exemplary embodiment of the disclosure.

FIG. 1 illustrates a blank 3 that is used to form a container 5 (FIGS. 2A and 2B) having a base layer 7 and a liner 9 according to a first embodiment of the disclosure. In one embodiment, the base layer comprises paperboard (e.g., solid bleached sulphate folding boxboard), or other suitable material that can be recyclable and/or suitable for use in an oven (not shown), and the liner 9 comprises a plastic layer such as polyethylene, a polyethylene terephthalate (PET) material, or any other thermoplastic material, or a bioplastic, such as vegetable oil or starch based plastics. In an exemplary embodiment, the liner 9 comprises PET or a similar material that is at least partially attached to the base layer 7 by a heat seal layer 10 (FIGS. 3A and 3B). For example, the heat seal layer 10 can include a thermoformable sealant grade transparent polyester packaging film, such as Mylar® XMPOL12 available from DuPont Teijin Films U.S. Limited Partnership of Hopewell, Virginia. Alternatively, the heat seal layer 10 could be any suitable thermoformable sealant or adhesive, any suitable heat or pressure activated adhesive, or any other suitable material. The container 5 is suitable for heating a food product (not shown) in an oven (not shown) such as a convection or conventional heating oven or microwave oven. In the illustrated embodiment, the liner 9 is at least partially attached to the base layer 7 and is in contact with the food product during heating. After heating the food product, the base layer 7 and the liner 9 can be separated to allow both the base layer 7 and the liner 9 to be recycled separately. U.S. Patent Application Publication No. 2011/0259784, published Oct. 27, 2011, and corresponding to U.S. patent application Ser. No. 12/992,131, filed Feb. 11, 2011, and PCT/GB/09/50506 filed May 13, 2009, are incorporated by reference herein for all purposes.

The blank 3 can be formed from a single ply of material, such as but not limited to paperboard, cardboard, paper, or a polymeric sheet, but alternatively, the blank can be formed from a laminate that includes more than one layer. In one embodiment, the blank 3 can include a microwave interactive layer (not shown) such as is common in MicroRite® containers available from Graphic Packaging International of Atlanta, GA The microwave interactive layer can be commonly referred to as, or can have as one of its components, a foil, a microwave shield, or any other term or component that refers to a layer of material suitable for shielding microwave energy and/or causing heating in a microwave oven.

As shown in FIG. 1, the blank 3 has a longitudinal direction L1 and a lateral direction L2. In the illustrated embodiment, the blank 3 has a bottom panel 11, a first end panel 13 foldably connected to the bottom panel at a lateral fold line 15, a second end panel 17 foldably connected to the bottom panel at a lateral fold line 19, a first side panel 21 foldably connected to the bottom panel 11 at a longitudinal fold line 23, and a second side panel 25 foldably connected to the bottom panel at a longitudinal fold line 27. In one embodiment, the blank 3 includes four panels (the two end panels 13, 17 and the two side panels 21, 25) extending around a perimeter of the bottom panel 11 so that the four fold lines 15, 19, 23, 27, form a rectangular perimeter of the bottom panel 11.

As shown in FIG. 1, the first end panel 13 includes a lower portion 13*a* foldably connected to an upper portion 13*b* along a lateral fold line 29, the second end panel 17 includes a lower portion 17*a* foldably connected to an upper portion 17*b* along a lateral fold line 31, the first side panel 21 includes a lower portion 21*a* foldably connected to an upper portion 21*b* along a lateral fold line 33, and the second side panel 25 includes a lower portion 25*a* foldably connected to an upper portion 25*b* along a lateral fold line 35. In the illustrated embodiment, the lower portions 13*a*, 17*a*, 21*a*, 25*a* of the respective panels 13, 17, 21, 25 are foldably connected to the bottom panel 11 along the respective fold lines 15, 19, 23, 27. In one embodiment, each of the lower portions 13*a*, 17*a* of the respective end panels 13, 17 has two lower oblique edges 37*a*, and each of the upper portions 13*b*, 17*b* of the respective end panels 13, 17 has two upper oblique edges 37*b*. Similarly, each of the lower portions 21*a*, 25*a* of the respective side panels 21, 25 has two lower oblique edges 39*a*, and each of the upper portions 21*b*, 25*b* of the respective side panels 21, 25 has two upper oblique edges 39*b*. In the illustrated embodiment, at each corner of the blank 3, the adjacent lower oblique edges 37*a*, 39*a* of the respective end panels 13, 17 and side panels 21, 25 extend at a first angle A1 with respect to one another and the adjacent upper oblique edges 37*b*, 39*b* of the respective end panels 13, 17 and side panels 21, 25 extend at a second angle A2 with respect to one another. The angle A1 can be smaller than the angle A2 in one embodiment. In an exemplary embodiment, the first angle A1 can be approximately 25 degrees and the second angle A2 can be approximately 70 or 80 degrees. Alternatively, the angles A1, A2 could be any suitable angle without departing from the disclosure.

In the illustrated embodiment, each of the end panels 13, 17 and side panels 21, 25 includes a respective flange portion 45, 47, 49, 51 at least partially defined by respective fold lines 61, 63, 65, 67 extending in the respective panels. In one embodiment, adjacent flange portions 45, 47, 49, 51 are configured to at least partially overlap when the blank 3 is formed into the container 5. The blank 3 could be otherwise shaped, arranged, and/or configured without departing from the disclosure. In addition, any of the bottom panel 11, the end panels 13, 17, the side panels 21, 25, and/or the flange portions 45, 47, 49, 51 could be omitted or could be otherwise shaped, arranged, positioned, and/or configured without departing from the disclosure. For example, the blank 3 could have any suitable number of panels and any suitable shape for the perimeter around the bottom panel 11.

Figure 2A:
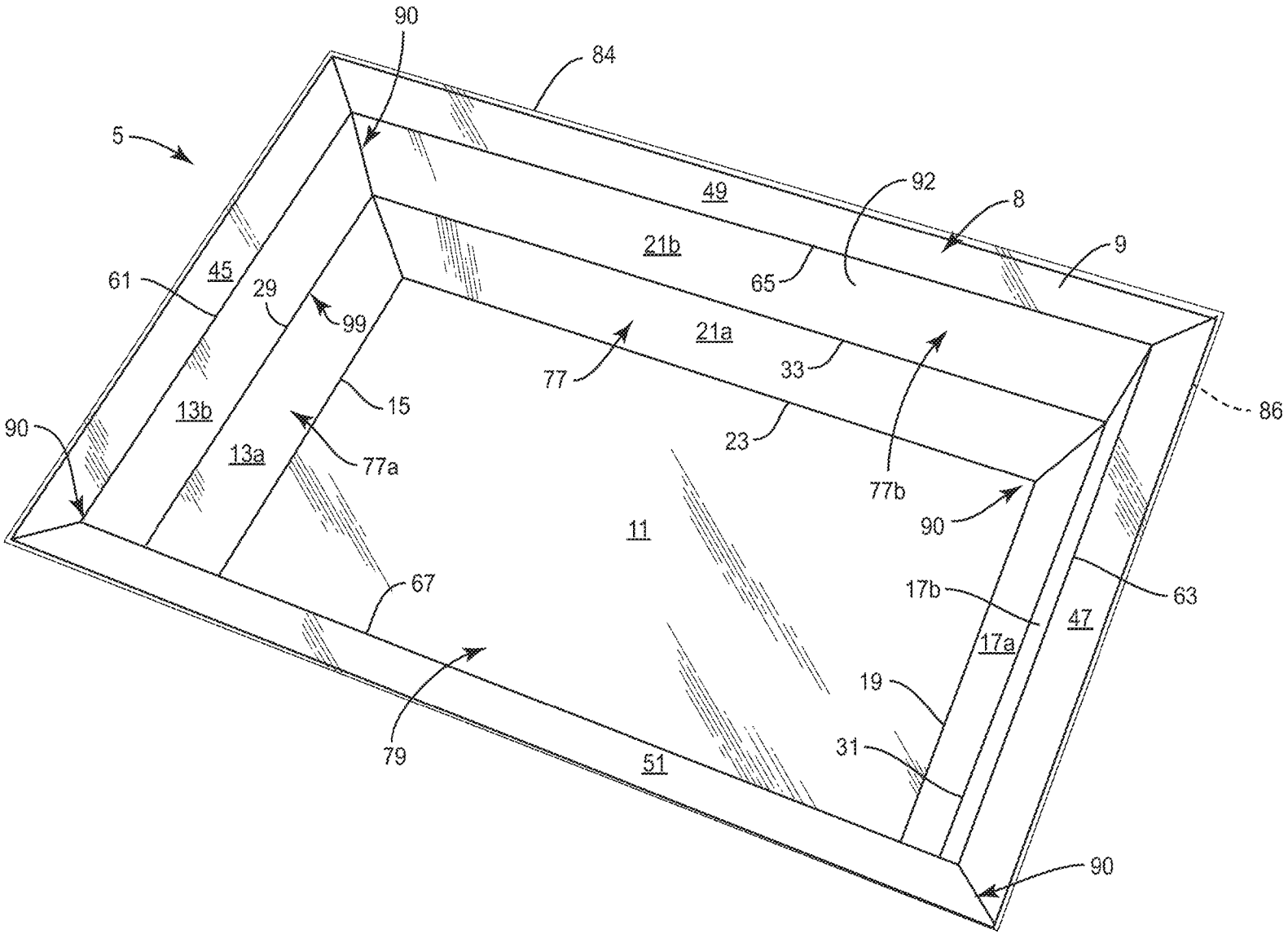
FIGS. 2A and 2B are perspective views of the container formed from the blank of FIG. 1 and a liner according to the first exemplary embodiment of the disclosure.
Figure 2B:
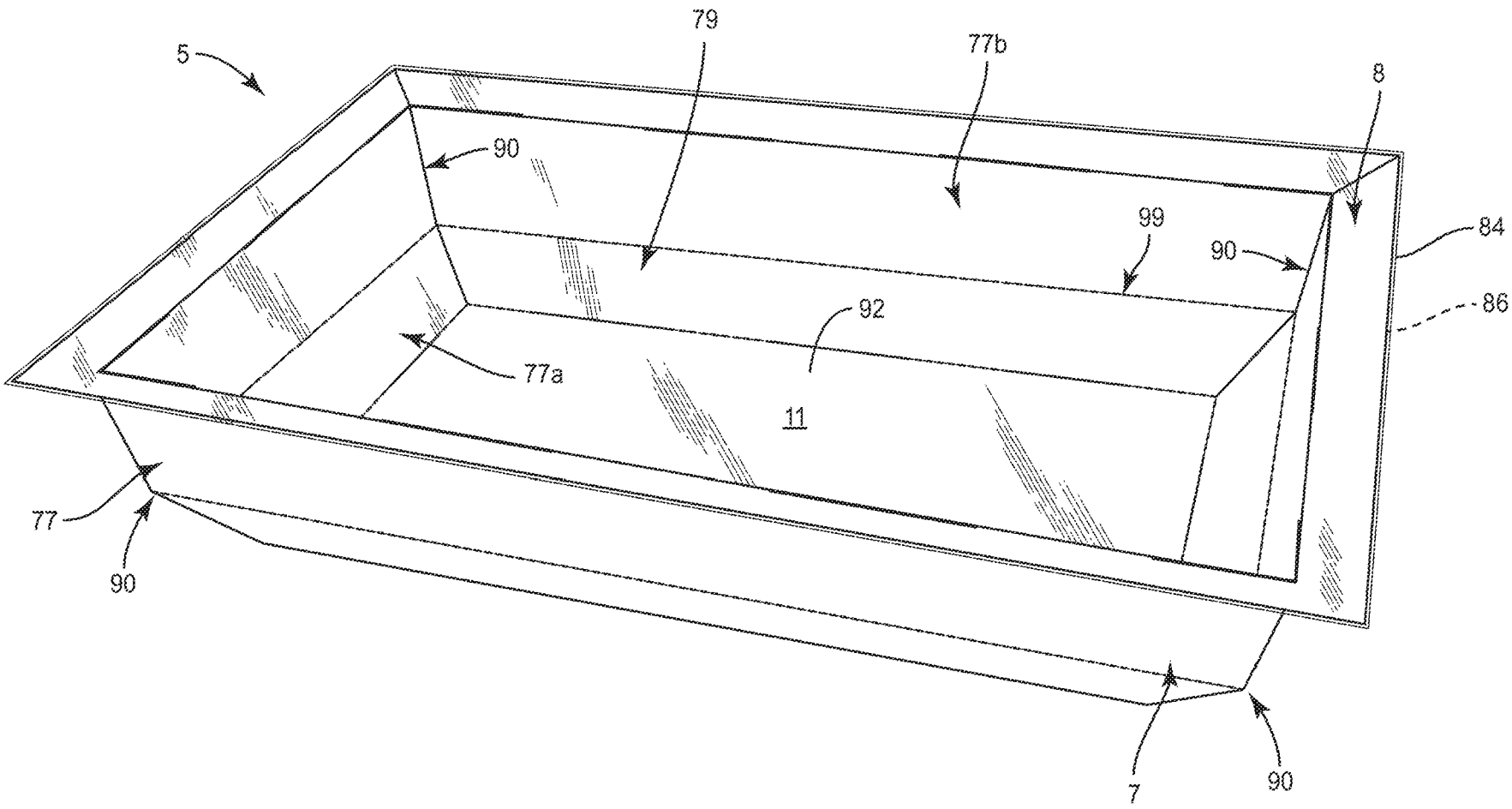
Figure 3A:
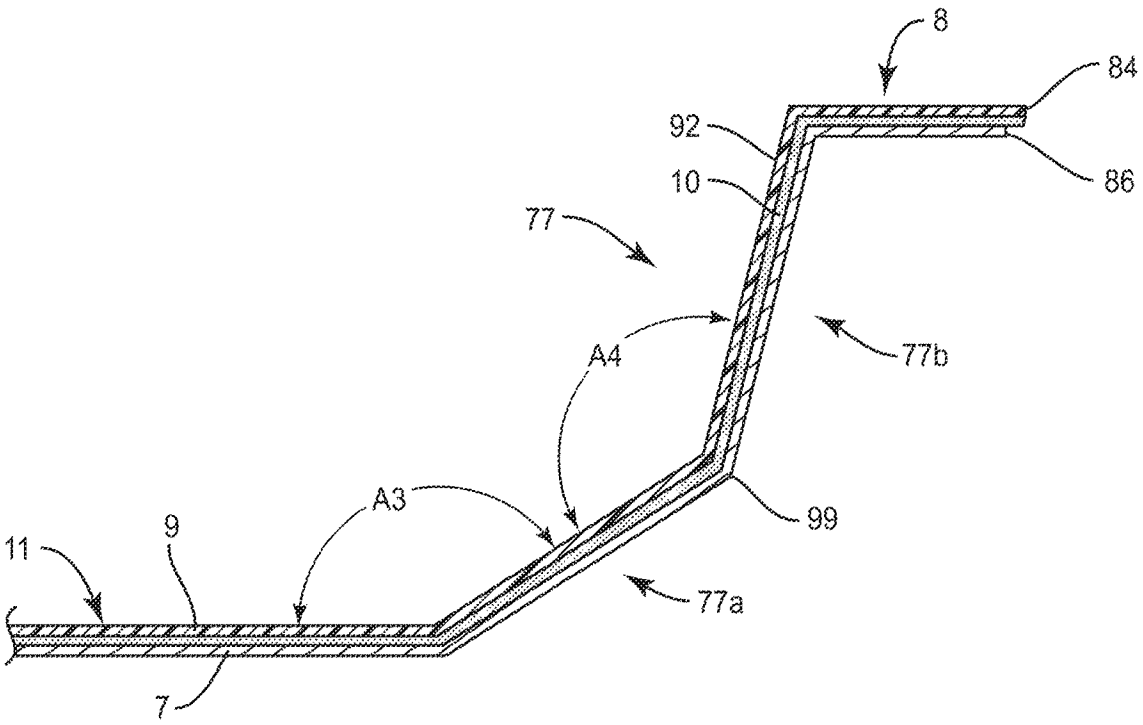
FIGS. 3A and 3B are schematic cross-sectional views of portions of the container of FIGS. 2A and 2B.
Figure 3B:
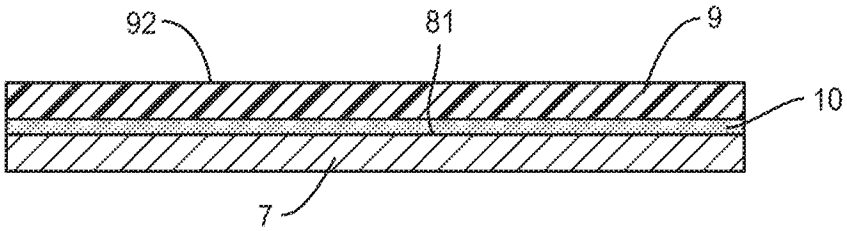

As shown in FIGS. 2A and 2B, the container 5 can be formed from the blank 3 by folding the end panels 13, 17 and the side panels 21, 23 upwardly along the respective fold lines 15, 19, 23, 27 to form a sidewall 77 extending around the perimeter of the bottom panel 11. In one embodiment, the sidewall 77 extends obliquely upwardly and outwardly from the bottom panel 11 around the perimeter of the container 5. As shown in FIGS. 2A and 2B, the lower portions 13*a*, 17*a*, 21*a*, 25*a* of the respective panels 13, 17, 21, 25 form a lower portion 77*a* of the sidewall 77 and the upper portions 13*b*, 17*b*, 21*b*, 25*b* of the respective panels 13, 17, 21, 25 form an upper portion 77*b* of the sidewall 77, wherein the fold lines 29, 31, 33, 35 can cooperate to at least partially form an intermediate fold line 99 extending around the sidewall 77. In the illustrated embodiment, as the end panels 13, 17 and side panels 21, 23 are folded upwardly to form the sidewall 77, the adjacent lower oblique edges 37*a*, 39*a* and upper oblique edges 37*b*, 39*b* are brought together (e.g., to be in engagement, to abut, to be at least partially in contact, and/or to be slightly spaced apart) at each corner 90 of the container 5. As shown in FIGS. 1, 2A, and 2B, since the angle A1 is different (e.g., smaller) than the angle A2, the lower portion 77*a* and the upper portion 77*b* of the sidewall 77 extend at different angles with respect to the bottom panel 11 (FIG. 3A). For example, as shown in FIG. 3A, the lower portion 77*a* can extend outwardly and upwardly from the bottom panel 11 at an angle A3 that is obtuse (e.g., greater than 90 degrees and less than 180 degrees), and the upper portion 77*b* extends upwardly at an obtuse angle A4 from the lower portion 77*a* (e.g., closer to the vertical direction than the lower portion 77*a* or in the vertical direction). In an exemplary embodiment, the transitions from the bottom panel 11 to the lower portion 77*a* and from the lower portion 77*a* to the upper portion 77*b* can be at angles of greater than 90 degrees, which can help increase the contact between the liner 9 and the base 7 (e.g., increase the surface area of the liner 9 that engages the base 7).

In the illustrated embodiment, the flange portions 45, 47, 49, 51 are folded along respective fold lines 61, 63, 65, 67 to extend outwardly from the respective end panels 13, 17 and side panels 21, 25 and are generally parallel to the bottom panel 11. As shown in FIGS. 2A and 2B, the flange portions 45, 47, 49, 51 form a flange 8 that extends outwardly from the sidewall 77 around the perimeter of the container 5. In one embodiment, the sidewall 77 can extend along substantially the entire perimeter of the bottom panel 11, and the flange 8 can extend along substantially the entire perimeter of the sidewall 77. As shown in FIGS. 2A and 2B, the sidewall 77 and the bottom panel 11 define an interior 79 of the container 5 and have an inner surface 92 extending along the interior 79. The flange 8, the sidewall 77, and/or the bottom panel 11 could be omitted or could be otherwise shaped, arranged, positioned, and/or configured without departing from the disclosure. Also, the container 5 can have one or more injection-molded features that can reinforce the flange 8 and/or other portions of the container without departing from the disclosure.

In the illustrated embodiment, the container 5 further includes the liner 9 attached to the inner surface 81 of the base layer 7 formed from the blank 3. As shown in FIGS. 3A and 3B, the liner 9 can be attached to the base layer 7 by the heat seal layer 10 (e.g., for a PET liner). Alternatively, the heat seal layer 10 could be applied to the base layer 7, without departing from the disclosure. Alternatively, the heat seal layer 10 could be omitted (e.g., for a polyethylene liner). The liner 9 can extend over the bottom panel 11, the sidewall 77, and the flange 8. In one embodiment, as shown in FIGS. 2A, 2B, and 3A, the liner 9 can extend beyond the flange 8 (e.g., so that an edge 84 of the liner 9 is outwardly spaced from an edge 86 of the flange 8). As shown in FIGS. 2A, 2B, and 3A, the edge 84 of the liner 9 can extend around an outer perimeter of the container 5. Alternatively, the edge 84 of the liner 9 could be aligned with the edge 86 of the flange 8 and/or could be spaced inwardly from the edge 86 (e.g., so that the edge 86 of the flange 8 extends around a perimeter of the container 5). In the illustrated embodiment, the liner 9 can be attached to at least a portion of each of the bottom panel 11, the end panels 13, 17, the side panels 21, 25, and the flange portions 45, 47, 49, 51. In one embodiment, the liner 9 can at least partially retain the base layer 7 in the shape of the sidewall 77 and the container 5 in general (e.g., can help prevent the end panels 13, 17 and the side panels 21, 25 from separating from one another). As shown in FIGS. 3A and 3B, the thicknesses of the liner 9 and the heat seal layer 10 are exaggerated in order to illustrate the configuration of the liner 9 and the heat seal layer 10 in the container 5. The container 5, including the liner 9, the heat seal layer 10, and/or the base layer 7, could be otherwise shaped, arranged, positioned, and/or configured without departing from the disclosure.

Figure 4:
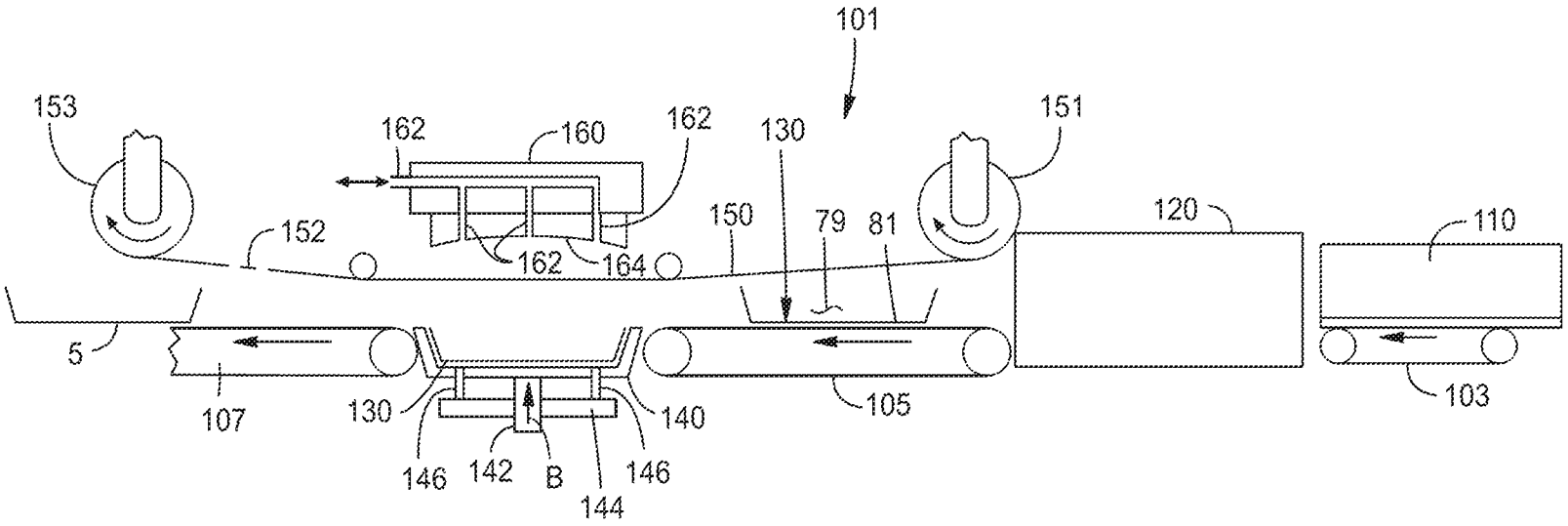
FIG. 4 is a schematic of an apparatus for forming a container of one embodiment of the disclosure.

FIG. 4 shows one embodiment of a system 101 and method for forming the container 5 that has the base layer 7 formed from the blank 3 and the inner layer 9 attached to the base layer 7. As shown in FIG. 4, the system includes a stack 110 of blanks 3 that are conveyed by a conveyor 103 to a container forming mechanism 120. In one embodiment, the container forming mechanism 120 can be any suitable mechanism or forming tool that can fold and/or press-form the blank 3 into the container 5, which can be similar to and have similar features and/or components as conventional forming tools such as are disclosed in U.S. Pat. No. 8,534,460, issued Sep. 17, 2013, the entire contents of which are incorporated herein by reference for all purposes. Also, the forming tool can have similar features and components such as the forming tool disclosed in U.S. Pat. No. 8,801,995, issued Aug. 12, 2014, the entire contents of which are incorporated by reference for all purposes, or any other suitable forming tool assembly. The mechanism 120 folds the end panels 13, 17 and side panels 21, 25 relative to the bottom panel 11 to form an unlined initial construct 130 that comprises the base layer 7 only. The initial construct 130 can be fed to a lower die 140 by a conveyor 105 and a PET plastic film sheet 150 can be fed from a supply roller 151 above the initial construct 130, the film sheet 150 having a thickness between approximately 30 and 150 microns in one exemplary embodiment. In one exemplary embodiment, the film sheet 150 can be a PET film having a thickness of approximately 50 microns. Alternatively, the film sheet 150 could have any suitable thickness. In the illustrated embodiment, a plurality of liners 9 can be formed from (e.g., cut from) the film sheet 150.

In the illustrated embodiment, the roll of the sheet 150 can be supplied with the heat seal layer 10 previously applied, and the sheet 150 can be unrolled from the supply roller 151 so that the heat seal layer 10 is on the underside of the sheet 150, facing the initial construct 130. In another embodiment, the heat seal layer 10 can be applied to the sheet 150 after it is unrolled from the supply roller 151 (e.g., by a spray applicator or a roller, not shown). Alternatively, the heat seal layer 10 could be omitted (e.g., for a sheet 150 of polyethylene or other suitable material) or the heat seal layer could be pre-applied as a coating to the blanks 3.

In one embodiment, the film sheet 150 could have perforations or other features (not shown) to help separate the liner 9 from the remainder of the sheet 150 when forming the container 5. An upper die 160 has a heater plate surface 164 having a PTFE coating, for example a Teflon® coating. Alternatively, the heater plate surface 164 could have a coating of any suitable material or the coating could be omitted. As schematically shown in FIG. 4, the upper die 160 can include a plurality of holes or ducts 162 in the heater plate surface 164 for applying a vacuum and/or air pressure on the sheet 150. The ducts 162 can each have a cross-sectional dimension (e.g., a diameter) of approximately 0.2 millimeter and can be grouped in clusters on the heater plate surface 164 (e.g., clusters of three ducts 164) that can be spaced on the heater plate. In another embodiment, the ducts 162 can be evenly spaced from one another and/or can have a cross-sectional dimension of approximately 1 millimeter. These exemplary configurations of the ducts 162 can help appropriately (e.g., evenly) apply heat and air pressure/vacuum to the sheet 150 and the heat seal layer 10 for forming the sheet 150 and heat seal layer 10 to the initial construct 140 and adhering the same to the initial construct 140. The lower die 140 and/or the upper die 160, including the ducts 162 and/or the heater plate 164, could be otherwise shaped, arranged, positioned, and/or configured without departing from the disclosure. For example, the heater plate 164 could be omitted and the heat could be alternatively applied to the sheet 150 (e.g., with a flow of hot air).

Figure 5:
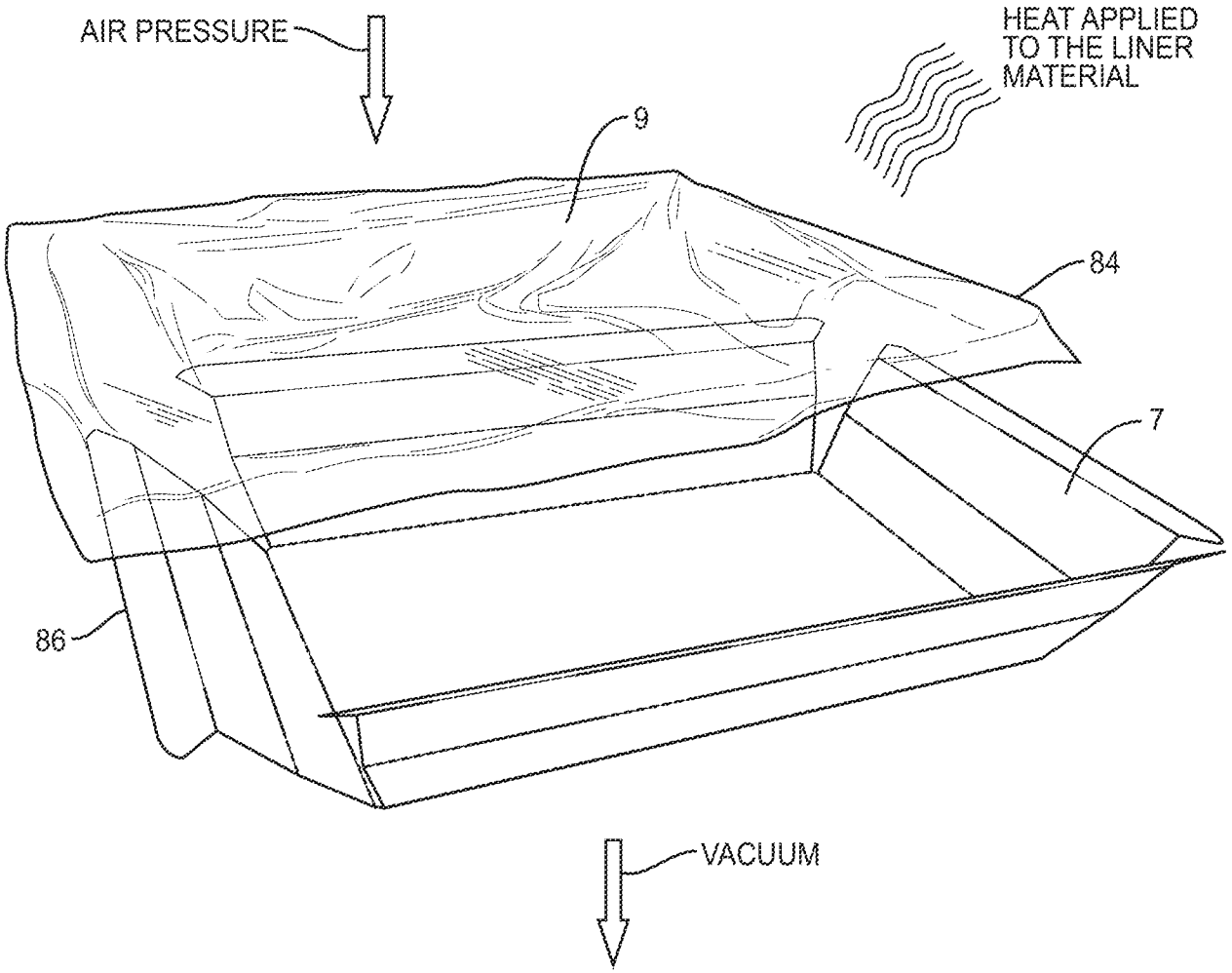
FIG. 5 is a schematic view of the application of the liner to the base layer of the container according to one embodiment of the disclosure.

In the illustrated embodiment, the lower die 140 can hold the construct 130 in its erected shape (schematically shown in FIGS. 4 and 5) as the liner 9 is applied to the base layer and can be raised in the direction of arrow B toward the upper die 160 by means of a pneumatic ram 142, and an initial vacuum is applied to ducts 162 to draw the film sheet 150 with the heat seal layer 10 toward the upper die 160. In the illustrated embodiment, the upper die 160 is heated to a suitable temperature (e.g., approximately 110 to 200 degrees Celsius or any other suitable temperature) so that the film sheet 150 and the heat seal layer 10 soften and form a domed shape (not shown) under the influence of the initial vacuum. In one embodiment, the film can at least partially conform to the concave heater plate surface 164 to form the domed shape. Instead of, or in addition to, the initial vacuum, air pressure under the film sheet 150 can be employed with similar or equal effect.

In the illustrated embodiment, as the film sheet 150 and the heat seal layer 10 are domed, the heat seal layer 10 is activated for attaching or bonding or adhering the sheet 150 to the initial construct 130 (e.g., its temperature increases such that it becomes tacky). Subsequently, film sheet 150 can be forced against the inner surface 81 of the recess 79 of the initial construct 130 with the tacky heat seal layer 10 therebetween. In one embodiment, the sheet 150 can be forced downwardly by means of air pressure either now applied to the ducts 162 and/or by means of a further vacuum applied from the bottom side of the film sheet 150. For example, a vacuum can be applied via the lower die 140 and through the initial construct 130, which can help hold the initial construct 130 in the cavity of the lower die 140 during application of the sheet 150 and the heat seal layer 10. In one embodiment, at least some of the fold lines 15, 19, 23, 27, 29, 31, 33, 35 can be at least partially formed by spaced cuts in the blank 3 (e.g., cut-crease style fold lines), and the vacuum can be applied to the sheet 150 through the cuts of the fold lines 15, 19, 23, 27, 29, 31, 33, 35. Alternatively, other apertures (not shown) can be provided in the initial construct 130 for allowing vacuum pressure to pass through the initial construct 130.

In one embodiment, the air pressure and/or vacuum causes the dome shape of the film sheet 150 to invert, and the now tacky and stretched heat seal layer 10 can adhere smoothly to the inner surface 81 of the initial construct 130 supported on the lower die 140. In one embodiment, the tackiness of the heat seal layer 10 can cause the portion of the film sheet 150 that forms the liner 9 to adhere to the base layer 7. The PTFE coated surface 164 can aid in the release of the liner material portion (e.g., the liner 9) of the film sheet 150 should the film sheet 150 make contact with the surface 164. In an embodiment where the heat seal layer 10 is omitted (e.g., for a polyethylene liner material), the liner material itself can become tacky due to the heating by the upper die 160 and the tackiness of the liner material can adhere the liner material to the interior surface 81 of the initial construct 130. In the illustrated embodiment, the excess or waste portion of the film sheet 150 is cut from the edges of the container 5 (which now includes the base layer 7 formed from the construct 130 and the liner 9 formed from the film sheet 150 with the heat seal layer 10 therebetween as shown in FIG. 3B) (e.g., by a cutting apparatus, not shown) to leave an unused film portion 152 with tray sized apertures. In one embodiment, the unused film portion 152 has marginal portions that remain intact around the apertures formed by the removal of the inner layer 9 from the film 150 so that the unused film portion 152 can continue to the take-up reel 153. Alternatively, or in addition, the film sheet 150 can have a sacrificial carrier layer (not shown) wherein the liner material separates from the carrier sheet when it is attached to the base layer 7. In another alternative, the unused film portion 152 can be in the form of scraps that are removed by air pressure and/or vacuum pressure, for example.

In the illustrated embodiment, the lower die 140 is lowered by reversing the direction of the ram 142, and a product support plate 144 can force the lined container 5 from the supporting lower die 140 as the ram 142 is lowered in order to eject the container 5 from the lower die 140. In one embodiment, the product support plate 144 can include upward extensions 146 that extend through the lower die 140 and engage the bottom of the container 5 due to the relative motion of the product support plate 144 and the lower die 140 toward one another. In the illustrated embodiment, the upward extensions 146 can position the container 5 relative to the lower die 140 so that a pusher rod, a puff of air, or other suitable mechanism can urge the container 5 onto a downstream conveyor 107. The lined container 5 then can be conveyed for packaging and/or further processing by the conveyor 107.

In one embodiment, the above mentioned process can be repeated to allow substantially continuous production of the lined containers 5. Since the above mentioned process can be employed in a variety of products and using different materials, it may be necessary to repeat the steps of heating the film and it may be necessary to then further force the film against the tray with air pressure, a vacuum, and/or another suitable mechanism. In particular, where thicker sheets of lining film are used for the inner layer 9 and various thicknesses of paperboard or other materials are used for the base layer 7, one or more repeats of the heating and forcing steps may be required in order for the film 9 to adhere to the base layer 7 tray effectively.

The system 101 and method described herein can include other features, steps, and/or the features and steps described herein can be omitted or modified without departing from the scope of the disclosure. For example, instead of or in addition to the heater plate 164, heat can be applied to the film sheet 150 in any suitable manner (e.g., by a flow of hot air). In another example, the film sheet 150 can be heated to activate (e.g., soften) the heat seal layer 10 without softening and/or deforming the remainder of the film sheet 150.

In the illustrated embodiment, the shape of the initial construct 130 can help increase the contact between the liner 9 and the heat seal layer 10 with the base layer 7. For example, since the angles between the bottom panel 11 and the lower portion 77*a* of the sidewall 77 and between the lower portion 77*a* and the upper portion 77*b* of the sidewall 77 can be greater than 90 degrees, the initial construct 130 can have fewer tight corners. In an exemplary embodiment, it can be difficult to force the sheet 150 into tighter corners (e.g., corners that are about 90 degrees or less). Accordingly, the shape of the sidewall 77 can help the entire liner 9 or substantially the entire liner 9 contact and be adhered to the base layer 7 including in all or substantially all of the corners of the initial construct 130.

The manufacturing process described above produces a readily sealable tray which is made mainly from readily recyclable materials (e.g. paperboard or cardboard and thermoplastic materials). If required, the paperboard base layer is readily removable from the thermoplastic film liner (e.g., after use of the container to hold a food product during heating in a microwave oven and/or in a conventional oven) because the degree of adherence between the base layer 7 and the liner 9 is controllable to give sufficient adherence so that the liner and the base layer remain attached before, during, and/or after heating of an item held in the container while allowing selective separation of the base layer and the liner after use. Using the parameters mentioned above, it has been found that the base layer 7 and the liner 9 of the container 5 are separable following heating of food in the container, such that the two peel apart, leaving no more than 5% of the thickness of the material of the base layer 7 stuck to the film of the inner layer 9 in one exemplary embodiment. The separated paperboard of the base layer 7 and the thermoplastic film of the inner layer 9 can be more easily recycled in separate waste streams (e.g., one for paper products and one for polymers) while minimizing the contamination of the material of the inner layer 9 with paperboard.

Advantageously, the use of the heater plate 164 to heat the film sheet 150 and the heat seal layer 10 prior to its application onto the initial construct 130 provides control of the temperature of the film sheet 150 and the heat seal layer 10 and thus the strength of its adherence to the initial construct 130. The use of the heater plate 164 also allows differential heating, so, for example, the film sheet 150 and the heat seal layer 10 could be heated to a higher temperature in the flange area 8 of the container 5, which in turn causes the liner 9 formed from the film sheet 150 to adhere more strongly to the flange 8 than to the remainder of the container 5 so that a further tray-sealing film applied to the liner 9 in the area of the flange has a more secure anchor to the container 5. In one embodiment, no injection molding features are used for the container 5 and a thinner plastic film can be employed, which can reduce the non-recyclable material content of the tray.

A PET plastics film 150 has been described above, although it will be understood that other plastics films could be used, for example other polyester based polymers could be used. Also a polyethylene film could be used and is favored for food packaging that is not heated (e.g., sandwich packs). It can be seen that the disclosure provides in one embodiment food packaging having a composite construction of a plastics inner food-contacting layer 9, bonded to an outer recyclable layer 7, the inner and outer layers being separable after use, such that no more than 5% of the thickness of the outer layer is disposed on the inner layer after separation.

In one embodiment, a lid (not shown) can comprise packaging film that is a thin plastic layer used to preserve and protect a food item contained in the tray and can be removably attached to the flange 8 of the container 5. Any plastic film, such as polyethylene, polypropylene, polyethylene terephthalate, polyvinylchloride, polyamide, and ethylene vinyl alcohol, or other suitable material, can be used for forming the lid that is sealed against the sealing surface of the flange 8. Further, adhesives can be used between the lid and the sealing surface of the flange 8 without departing from the disclosure.

Figure 6:
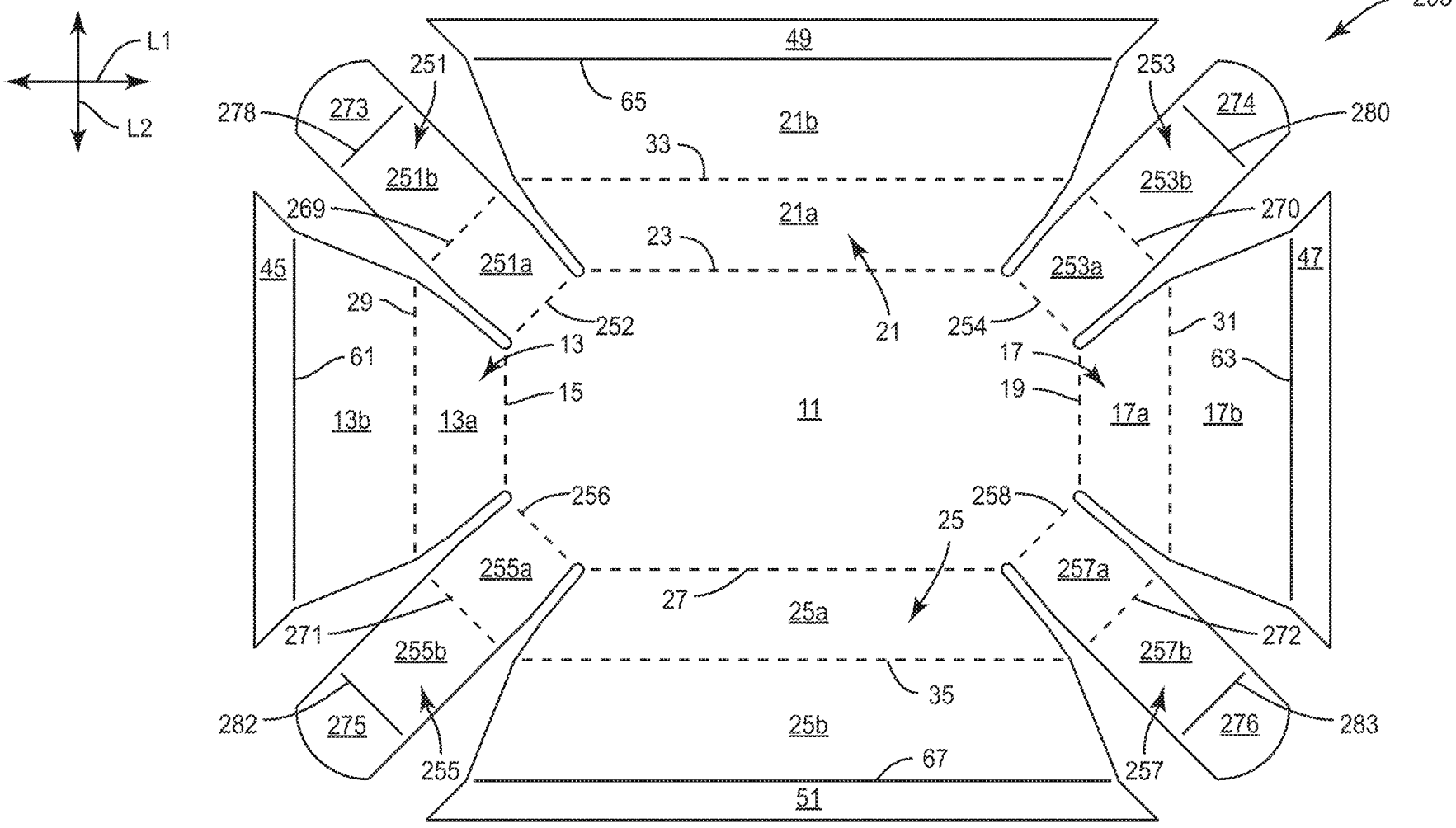
FIG. 6 is a plan view of a blank used for forming a container according to a second exemplary embodiment of the disclosure.

FIG. 6 is a plan view of a blank 203 for forming a container 205 (FIG. 7) of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 6, the blank 203 is similar to the blank 3 of the first embodiment except that the blank 203 includes corner panels 251, 253, 255, 257 respective foldably connected to the bottom panel 11 at respective oblique fold lines 252, 254, 256, 258. As shown in FIG. 6, the corner panels 251, 253, 255, 257 are disposed between respective adjacent end panels 13, 17 and side panels 21 25. In one embodiment, the blank 203 includes eight panels (the two end panels 13, 17, the two side panels 21, 25, and the four corner panels 251, 253, 255, 257) extending around a perimeter of the bottom panel 11 so that the eight fold lines 15, 17, 23, 27, 252, 254, 256, 258 form an octagonal perimeter of the bottom panel 11. As shown in FIG. 6, each of the fold lines 15, 17, 23, 27, 252, 254, 256, 258 can be oblique with respect to its respectively adjacent fold lines and can form an obtuse angle with each of its respectively adjacent fold lines.

Figure 7:
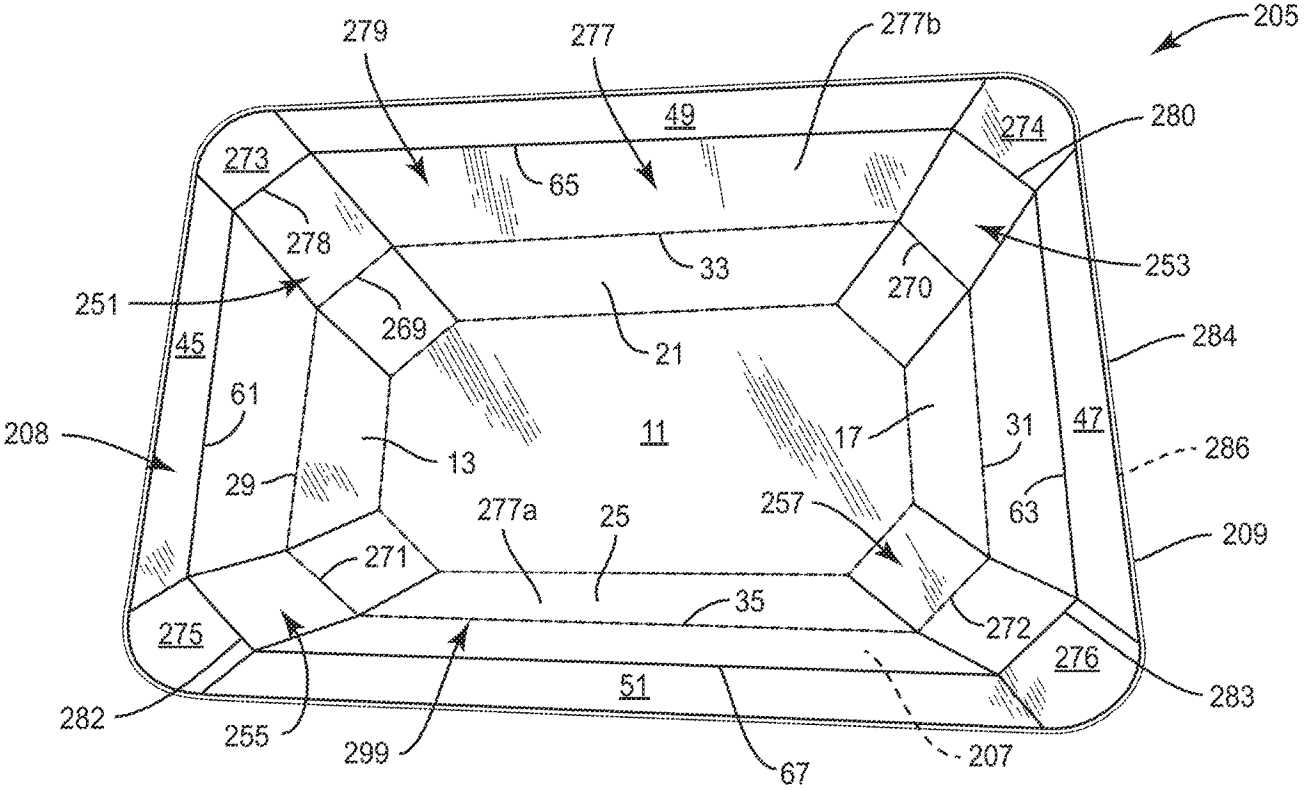
FIG. 7 is a perspective view of the container formed from the blank of FIG. 6 and a liner according to the second exemplary embodiment of the disclosure.

As shown in FIG. 6, each of the corner panels 251, 253, 255, 257 can include a respective intermediate fold line 269, 270, 271, 272 so that each of the corner panels includes a lower portion 251*a*, 253*a*, 255*a*, 257*a* foldably connected to a respective upper portion 251*b*, 253*b*, 255*b*, 257*b* along the respective fold line 269, 270, 271, 272. Accordingly, in one embodiment, the lower portions 251*a*, 253*a*, 255*a*, 257*a* of the corner panels 251, 253, 255, 257 can cooperate with the lower portions 13*a*, 17*a* of the end panels 13, 17 and the lower portions 21*a*, 25*a* of the side panels 21, 25 to form the lower portion 277*a* of the sidewall 277, and the upper portions 251*b*, 253*b*, 255*b*, 257*b* of the corner panels 251, 253, 255, 257 can cooperate with the upper portions 13*b*, 17*b* of the end panels 13, 15 and the upper portions 21*b*, 25*b* of the side panels 21, 25 to form the upper portion 277*b* of the sidewall 277 (FIG. 7). In the illustrated embodiment, flange portions 273, 274, 275, 276 can be foldably connected to the respective corner panels 251, 253, 255, 257 along respective fold lines 278, 280, 282, 283 and can cooperate with the flange portions 45, 47, 49, 51 to form the flange 208. In one embodiment, the blank 203 can be similar to the blank of the second embodiment as shown and described in the incorporated-by-reference U.S. patent application Ser. No. 15/654,814, filed Jul. 20, 2017. The blank 203 could be otherwise shaped, arranged, and/or configured without departing from the disclosure.

Figure 8:
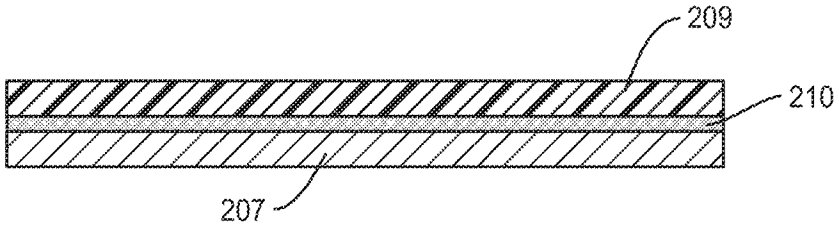
FIG. 8 is a cross-sectional view of a portion of the container of FIG. 7.

In the illustrated embodiment, the container 205 can be formed from the blank 203 and the liner material (e.g., of the film sheet 150) in a similar or identical manner as described above with respect to the first embodiment. Accordingly, the container 205 can include the base layer 207 formed from the blank 203 and the liner 209 formed from the film sheet 150. In one embodiment, the liner 209 can be attached to the base layer 207 with a heat seal layer 210 (FIG. 8) similarly to the first embodiment described above. As shown in FIG. 7, each of the corner flange portions 273, 274, 275, 276 can overlap a portion of the respectively adjacent flange portions of the end panels and side panels to form the flange 208.

As shown in FIG. 7, the lateral fold lines 229, 231, the longitudinal fold lines 233, 235, and the oblique fold lines 269, 270, 271, 272 can cooperate to form an intermediate fold line 299 extending around the sidewall 277. In addition, the lower portion 277*a* and the upper portion 277*b* of the sidewall 277 each can extend from the intermediate fold line 299, wherein the portions of the sidewall 277 are oblique with respect to one another. In one embodiment, the upper and lower portions of the sidewall 277 can cooperate to form an obtuse angle, and the lower portion 277*a* of the sidewall 277 can form an obtuse angle with the bottom panel 11. The obtuse angles in the sidewall 277 can allow the base layer 207 to conform with the liner 209 more completely, which can increase the contact between the surfaces of the base layer 207 and the liner 209 (e.g., at the transitions between the panels of the container 205).

In one embodiment, the container 205, with the corner panels 251, 253, 255, 257 that extend obliquely between adjacent end panels 13, 17 and side panels 21, 25, generally includes only obtuse angles between the panels and lacks orthogonal angles. This can help enable the liner material that forms the liner 9 to come into contact with more of the surface area of the base layer (e.g., relative to a base layer with right or acute angles, wherein it can be more difficult for the liner material to extend into such corners). Accordingly, the octagonal shape of the sidewall 277 can help the liner 9 to adhere to the entire surface or to substantially the entire surface of the base layer of the container. In one embodiment, the octagonal shape of the sidewall 277 can more closely approximate a rounded or circular sidewall than a container with four orthogonal sides. The container 205 could be otherwise shaped, arranged, and/or configured without departing from the disclosure.

Figure 9:
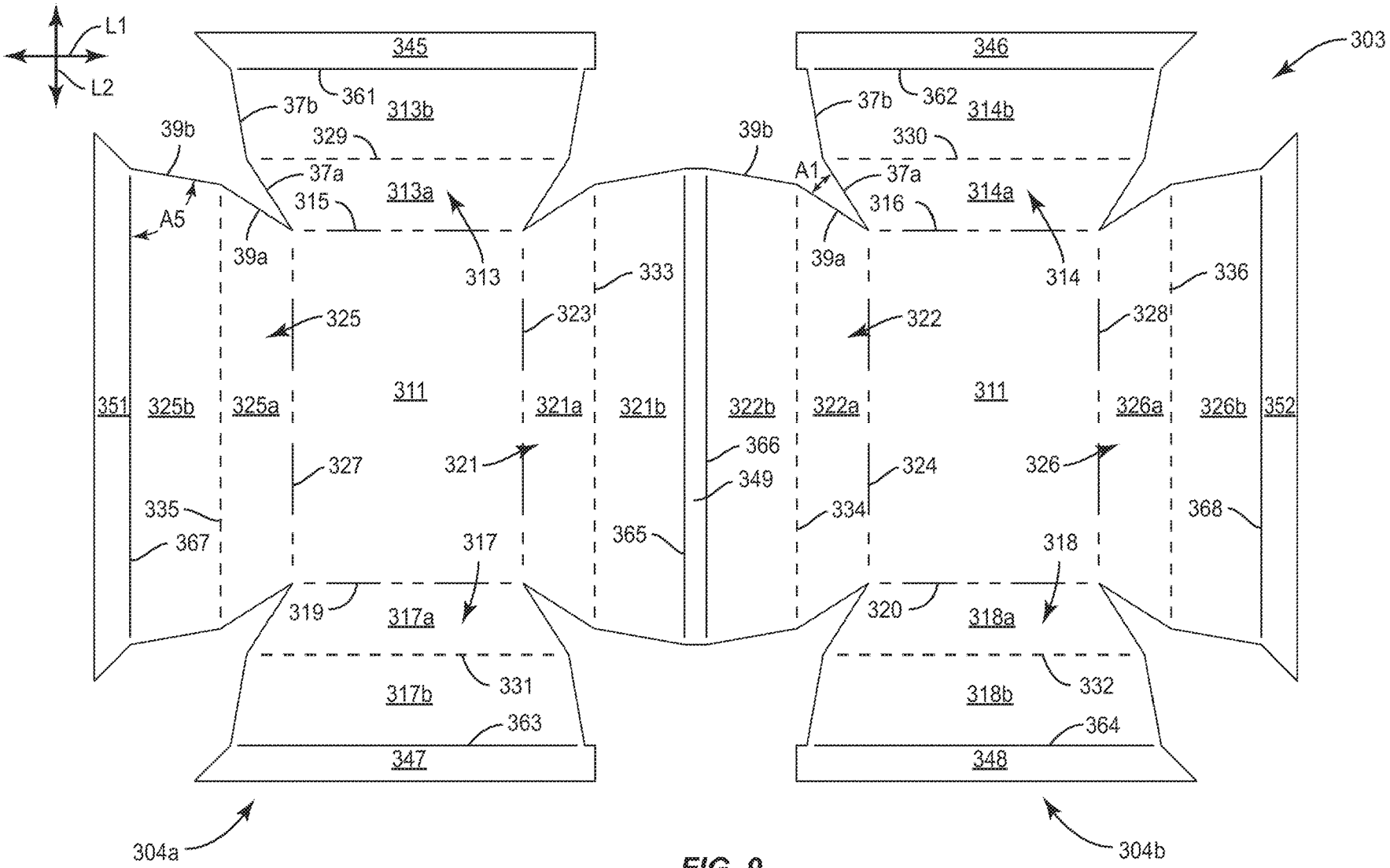
FIG. 9 is a plan view of a blank used for forming a container according to a third exemplary embodiment of the disclosure.
Figure 10:
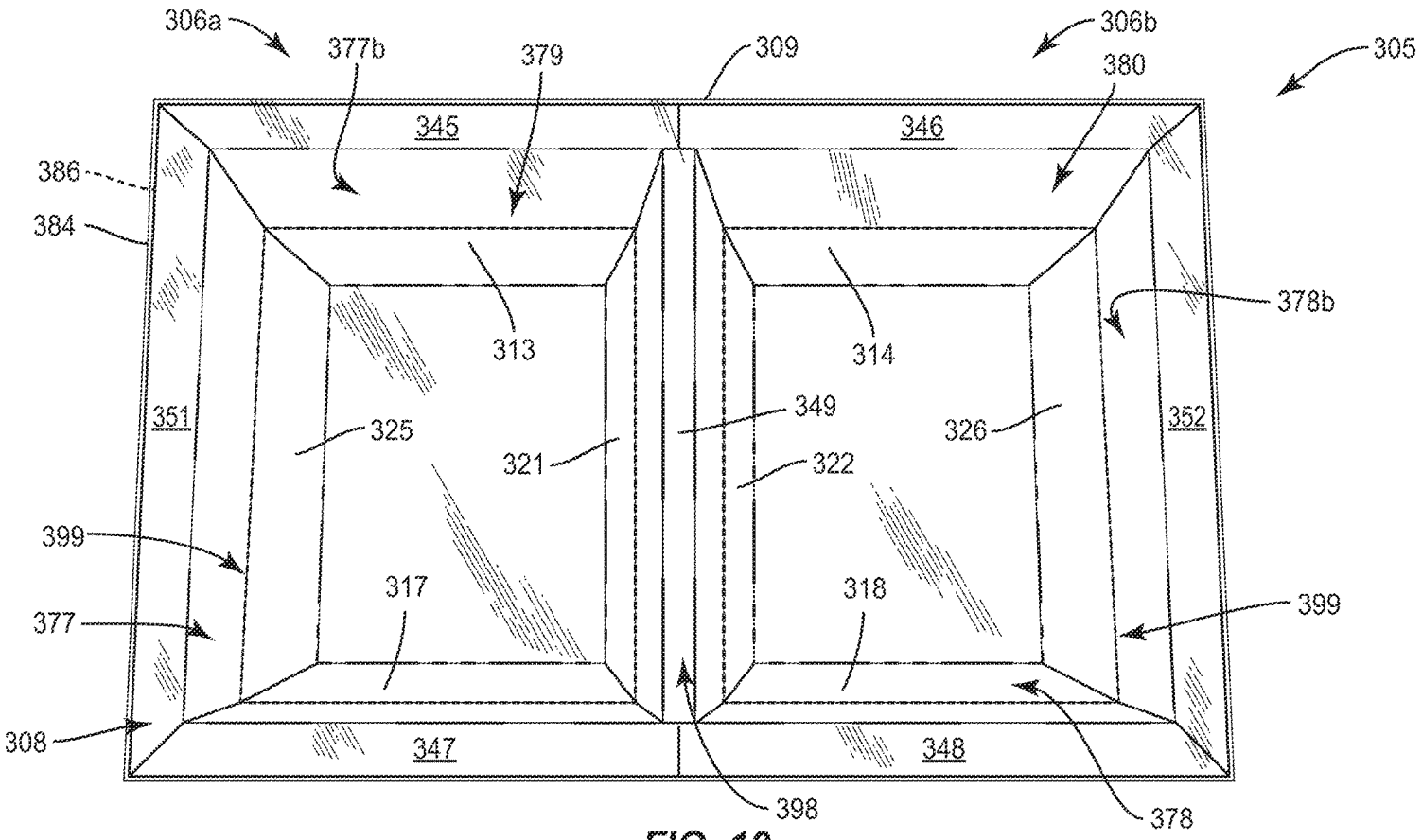
FIG. 10 is a perspective view of the container formed from the blank of FIG. 9 and a liner according to the third exemplary embodiment of the disclosure.

FIG. 9 is a plan view of a blank 303 for forming a container 305 (FIG. 10) of a third embodiment of the disclosure. The third embodiment is generally similar to the prior embodiments, except for variations noted and variations that will be apparent to one of ordinary skill in the art. Accordingly, similar or identical features of the embodiments have been given like or similar reference numbers. As shown in FIG. 9, the blank 303 is similar to the blank 3 of FIG. 1 of the first embodiment except that the blank 303 includes two sections 304*a*, 304*b* for forming two respective compartments 306*a*, 306*b* in the container 305 (FIG. 10). In one embodiment, each of the sections 304*a*, 304*b* is similar to the blank 3 of the first embodiment. The first section 304*a* includes a bottom panel 311 foldably connected to end panels 313, 317 along respective fold lines 315, 319 and to side panels 321, 325 along respective fold lines 323, 327. Each of the end panels 313, 317 can have a lower portion 313*a*, 317*a* foldably connected to a respective upper portion 313*b*, 317*b* along respective fold lines 329, 331, and each of the side panels 321, 325 can include a lower portion 321*a*, 325*a* foldably connected to respective upper portions 321*b*, 325*b* along respective fold lines 333, 335. Flange portions 345, 347, 351 are foldably connected to the respective panels 313, 317, 325 along respective fold lines 361, 363, 367 in the first section 304*a*. The first section could be otherwise shaped, arranged, and/or configured without departing from the disclosure.

As shown in FIG. 9, the second section 304*b* can be similarly configured to the first section 304*a* with a bottom panel 312 foldably connected to end panels 314, 318 along respective fold lines 316, 320 and to side panels 322, 326 along respective fold lines 324, 328. Each of the end panels 314, 318 can have a lower portion 314*a*, 318*a* foldably connected to a respective upper portion 314*b*, 318*b* along respective fold lines 330, 332, and each of the side panels 322, 326 can include a lower portion 322*a*, 326*a* foldably connected to respective upper portions 322*b*, 326*b* along respective fold lines 334, 336. Flange portions 346, 348, 352 are foldably connected to the respective panels 314, 318, 326 along respective fold lines 362, 364, 368 in the second section 304*b*. The second section could be otherwise shaped, arranged, and/or configured without departing from the disclosure.

In the illustrated embodiment, the first section 304*a* and the second section 304*b* can be connected by a shared central flange portion 349 foldably connected to the side panel 321 of the first section 304*a* and the side panel 322 of the second section 304*b* along respective fold lines 365, 366. As shown in FIG. 9, the flange portions 345, 346, 347, 348 can have inner square ends where the flange portions 345, 346 and 347, 348 overlap when the flange 308 is formed (FIG. 10). In one embodiment, the adjacent lower edges 37*a*, 39*a* at each of the eight corners of the blank 303 can extend at an angle A1 with respect to one another and each of the upper edges 37*b*, 39*b* can extend at an angle A5 with respect to the respective fold line 361, 362, 363, 364, 365, 366, 367, 368. In one example, the angle A1 can be approximately 25 degrees and the angle A5 can be approximately 80 degrees (and the adjacent upper edges 37*b*, 39*b* can extend at an angle of approximately 70 degrees with respect to one another). The blank 303 could be otherwise shaped, arranged, and/or configured without departing from the disclosure. For example, the sections 304*a*, 304*b* could be connected at different panels (e.g., at end panels) and/or the central flange portion 349 could be omitted so that the connected panels are connected along a fold line.

Figure 11:
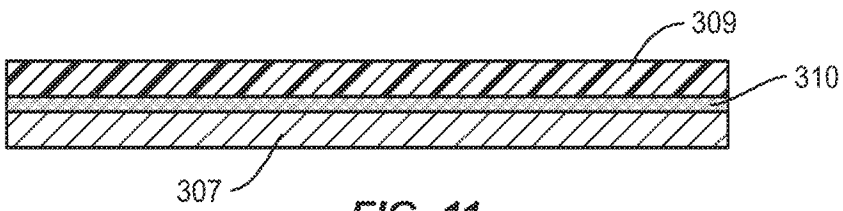
FIG. 11 is a cross-sectional view of a portion of the container of FIG. 10.

In the illustrated embodiment, the container 305 (e.g., dual-compartment container) can be formed from the blank 303 and the liner material (e.g., of the film sheet 150) in a similar or identical manner as described above with respect to the first embodiment. Accordingly, the container 305 can include the base layer 307 formed from the blank 303 and the liner 309 formed from the film sheet 150. In one embodiment, the liner 309 can be attached to the base layer 307 with a heat seal layer 310 (FIG. 11) as described above. As shown in FIG. 10, each section 304*a*, 304*b* of the blank 303 is formed into a respective compartment 306*a*, 306*b* of the container 305, wherein the end panels 313, 317 and the side panels 321, 325 of the first section 304*a* are folded with respect to the bottom panel 311 to form a first sidewall 377 of the first compartment 306*a* and the end panels 314, 318 and the side panels 322, 326 of the second section 304*b* are folded with respect to the bottom panel 312 to form a second sidewall 378 of the second compartment 306*b*. As shown in FIG. 10, the sidewalls 377, 378 can include the respective side panels 321, 322 extending between the compartments 306*a*, 306*b*, connected at the central flange portion 349, which cooperates with the flange portions 345, 346, 347, 348, 352, 352 to form the flange 308 of the container 305.

In one embodiment, the side panels 321, 322 and the central flange portion 349 can form a divider wall 398 that at least partially divides the container 305 into the compartments 306*a*, 306*b*. In the illustrated embodiment, the sidewall 377 can extend along a perimeter of the bottom panel 311, and the sidewall 377 and the bottom panel 311 can extend along an interior 379 of the first compartment 306*a*. Similarly, the sidewall 378 can extend along a perimeter of the bottom panel 312, and the sidewall 378 and the bottom panel 312 can extend along an interior 380 of the second compartment 306*b*. As shown in FIG. 10, the liner 309 can extend beyond the edge 386 of the base material 307 so that the edge 384 of the liner 309 is spaced apart from the edge 386 of the base material 307.

As shown in FIG. 10, the fold lines 329, 331, 333, 335 and the fold lines 330, 332, 334, 336 can cooperate to form respective intermediate fold lines 399 extending around the respective sidewalls 377, 378. Accordingly, the lower portion 377*a* and the upper portion 377*b* of the first sidewall 377 each can extend from the intermediate fold line 399 in the first compartment 306*a*, wherein the portions of the sidewall 377 are oblique with respect to one another. In one embodiment, the upper and lower portions of the sidewall 377 can cooperate to form an obtuse angle, and the lower portion 377*a* of the sidewall 377 can form an obtuse angle with the bottom panel 311 in the first compartment 306*a*. Similarly, the lower portion 378*a* and the upper portion 378*b* of the second sidewall 378 each can extend from the intermediate fold line 399 in the second compartment 306*b*, wherein the portions of the sidewall 378 are oblique with respect to one another. In one embodiment, the upper and lower portions of the sidewall 378 can cooperate to form an obtuse angle, and the lower portion 378*a* of the sidewall 378 can form an obtuse angle with the bottom panel 312 in the second compartment 306*b*. The obtuse angles in the sidewalls 377, 378 can allow the base layer 307 to conform with the liner 309 more completely, which can increase the contact between the surfaces of the base layer 307 and the liner 309 (e.g., at the transitions between the panels of the container 305) in both compartments 306*a*, 306*b*.

The container 305 could be otherwise shaped, arranged, and/or configured without departing from the disclosure. For example, one or both of the compartments 306*a*, 306*b* could include one or more corner panels similar or identical to the corner panels shown and described in the second embodiment of the disclosure.

Any of the features of the various embodiments of the disclosure can be combined with, replaced by, or otherwise configured with other features of other embodiments of the disclosure without departing from the scope of this disclosure.

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

Any of the blanks, containers, or other constructs of this disclosure may optionally include one or more features that alter the effect of microwave energy during the heating or cooking of a food item that is associated with the tray or other construct. For example, the blank, tray, container, or other construct may be formed at least partially from one or more microwave energy interactive elements (hereinafter sometimes referred to as "microwave interactive elements") that promote heating, browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor or shield, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Atlanta, GA) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. Nos. 5,412,187, 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A container for heating a food product, the container comprising:

a base layer of material;

a liner releasably attached to an inner surface of the base layer, wherein the liner is at least partially attached to the base layer by a heat seal layer, and the liner is separable from the base layer after heating the container;

a bottom panel; and a sidewall extending along the bottom panel, the sidewall comprises a lower portion extending upwardly and outwardly from the bottom panel and an upper portion extending from the lower portion, wherein the lower portion and the upper portion of the sidewall are foldably connected along an intermediate fold line, the lower portion is oblique with respect to the bottom panel, the upper portion is oblique with respect to the lower portion, and the upper portion extends at an obtuse angle from the lower portion along the inner surface; and a flange extending outwardly from the sidewall;

the sidewall comprising at least an end panel foldably connected to the bottom panel and a side panel foldably connected to the bottom panel, wherein the end panel comprises a first lower edge extending along the lower portion of the sidewall from the bottom panel to the intermediate fold line and a first upper edge extending along the upper portion of the sidewall from the intermediate fold line to the flange, the side panel comprises a second lower edge extending along the lower portion of the sidewall from the bottom panel to the intermediate fold line and a second upper edge extending along the upper portion of the sidewall from the intermediate fold line to the flange, the first lower edge and the first upper edge abutting the respective second lower edge and second upper edge at a corner of the container.

2. The container of claim 1, wherein the liner comprises polyethylene terephthalate and the heat seal layer comprises polyester.

3. The container of claim 2, wherein the heat seal layer comprises a sealant grade transparent polyester packaging film.

4. The container of claim 1, wherein the sidewall extends upwardly from the bottom panel along a perimeter of the bottom panel.

5. The container of claim 1, wherein the obtuse angle is a second obtuse angle, and the lower portion extends at a first obtuse angle with respect to the bottom panel.

6. The container of claim 1, wherein the liner is releasably attached to the base layer along at least a portion of each of the bottom panel and the lower portion and upper portion of the sidewall.

7. The container of claim 1, wherein the lower portion extends along a perimeter of the bottom panel.

8. A container for heating a food product, the container comprising a base layer of material and a liner releasably attached to an inner surface of the base layer, wherein the liner is separable from the base layer after heating the container;

a bottom panel; and a sidewall comprising at least an end panel foldably connected to the bottom panel and a side panel foldably connected to the bottom panel, wherein each of the end panel and the side panel extends along a corner of the container; and a flange extending outwardly from the sidewall;

the sidewall comprising a lower portion extending along the bottom panel and an upper portion extending upwardly from the lower portion along an intermediate fold line, wherein the lower portion is oblique with respect to the bottom panel, the upper portion is oblique with respect to the lower portion, and the upper portion extends at an obtuse angle from the lower portion along the inner surface;

wherein the end panel comprises a first lower edge extending along the lower portion of the sidewall from the bottom panel to the intermediate fold line and a first upper edge extending along the upper portion of the sidewall from the intermediate fold line to the flange, the side panel comprises a second lower edge extending along the lower portion of the sidewall from the bottom panel to the intermediate fold line and a second upper edge extending along the upper portion of the sidewall from the intermediate fold line to the flange, the first lower edge and the first upper edge abutting the respective second lower edge and second upper edge at the corner of the container.

9. The container of claim 8, wherein the lower portion extends upwardly and outwardly from the bottom panel.

10. The container of claim 9, wherein the obtuse angle is a second obtuse angle, and the lower portion extends at a first obtuse angle with respect to the bottom panel.

11. The container of claim 10, wherein the liner is releasably attached to the base layer along at least a portion of each of the bottom panel, the lower portion of the sidewall, and upper portion of the sidewall.

12. The container of claim 11, wherein the liner is releasably attached to the base layer along at least a portion of each of the side panel and the end panel.

13. The container of claim 11, the liner being releasably attached to the base layer along at least a portion of the flange.

14. The container of claim 13, wherein the liner comprises an outer edge that is outwardly spaced from an edge of the flange.

15. The container of claim 8, wherein the end panel is a first end panel, the side panel is a first side panel, and the sidewall further comprises a second end panel disposed opposite to the first end panel and a second side panel disposed opposite to the first side panel, each of the first end panel and the second end panel abutting each of the first side panel and the second side panel at respective corners of the container.

16. The container of claim 8, wherein the bottom panel is a first bottom panel and the sidewall is a first sidewall, and the container further comprises a first compartment and a second compartment, the first compartment comprising the first bottom panel and the first sidewall, and the second compartment comprising a second bottom panel and a second sidewall extending along the second bottom panel.

17. The container of claim 16, wherein the first compartment and the second compartment are connected along a divider wall, the divider wall comprising at least a portion of each of the first sidewall and the second sidewall.

18. The container of claim 16, further comprising a divider wall, wherein the flange extends outwardly from the first sidewall and the second sidewall, the flange comprises a central flange portion, the first sidewall comprises a first panel foldably connected to the central flange portion, the second sidewall comprises a second panel foldably connected to the central flange portion, and the divider wall comprises the first panel, the second panel, and the central flange portion.

19. The container of claim 16, wherein the lower portion, the upper portion, and the intermediate fold line of the first sidewall are a first lower portion, a first upper portion, and a first intermediate fold line, respectively, and the second sidewall comprises a second lower portion extending along the second bottom panel and a second upper portion extending upwardly from the second lower portion along a second intermediate fold line.

20. The container of claim 19, wherein each of the first lower portion and the second lower portion extends at a first angle with respect to the respective first bottom panel and second bottom panel and each of the first upper portion and the second upper portion extends at a second angle with respect to the respective first lower portion and second lower portion, and each of the first angle and the second angle is obtuse.

21. The container of claim 8, wherein the lower portion extends along a perimeter of the bottom panel.

22. In combination, a blank and a liner material for forming a container for heating a food product, the blank comprising:

a bottom panel;

an end panel foldably connected to the bottom panel and a side panel foldably connected to the bottom panel;

the end panel and the side panel being for at least partially forming a sidewall comprising a lower portion extending along the bottom panel and an upper portion extending upwardly from the lower portion along an intermediate fold line when the container is formed from the blank and the liner material, wherein the lower portion is for being oblique with respect to the bottom panel and the upper portion is for being oblique with respect to the lower portion when the container is formed from the blank and the liner material;

a first flange portion extending from the end panel and a second flange portion extending from the side panel, wherein the first flange portion and the second flange portion at least partially form a flange extending outwardly from the sidewall when the container is formed from the blank and the liner material;

wherein the blank is for forming a base layer of the container, the liner material is for forming a liner that is releasably attached to an inner surface of the base layer when the container is formed from the blank and the liner material, and the liner is separable from the base layer after heating of the container formed from the blank and the liner material;

wherein the end panel comprises a first lower edge extending from the bottom panel to the intermediate fold line and a first upper edge extending from the intermediate fold line to the first flange portion, the side panel comprises a second lower edge extending from the bottom panel to the intermediate fold line and a second upper edge extending from the intermediate fold line to the second flange portion, the first lower edge extends at a first angle with respect to the second lower edge, the first upper edge extends at a second angle with respect to the second upper edge, and the first angle is different than the second angle, the first lower edge and the first upper edge being for abutting the respective second lower edge and second upper edge at the corner of the container formed from the blank and the liner material;

wherein, when the container is formed from the blank and the liner material, the upper portion of the sidewall is for extending at an obtuse angle from the lower portion of the sidewall along the inner surface.

23. The combination of claim 22, wherein the second angle is larger than the first angle.

24. The combination of claim 22, wherein the obtuse angle is a second obtuse angle, the first angle and the second angle are configured so that the lower portion of the sidewall extends at a first obtuse angle with respect to the bottom panel and the upper portion of the sidewall extends at the second obtuse angle with respect to the lower portion of the sidewall when the container is formed from the blank and the liner material.

25. The combination of claim 22, wherein the lower portion of the sidewall extends at a third angle with respect to the bottom panel and the upper portion of the sidewall extends at a fourth angle with respect to the lower portion when the container is formed from the blank and the liner material, each of the third angle and the fourth angle is obtuse, and the liner is releasably attached to the base layer along at least a portion of each of the bottom panel, the lower portion of the sidewall, and the upper portion of the sidewall.

26. The combination of claim 25, the liner being releasably attached to the base layer along at least a portion of the flange when the container is formed from the blank and the liner material.

27. The combination of claim 22, wherein the end panel is a first end panel, the side panel is a first side panel, and the blank further comprises a second end panel disposed opposite to the first end panel and a second side panel disposed opposite to the first side panel, each of the first end panel and the second end panel abutting each of the first side panel and the second side panel at respective corners of the container formed from the blank and the liner material.

28. The combination of claim 22, wherein the bottom panel is a first bottom panel, the end panel is a first end panel, the side panel is a first side panel, and the sidewall is a first sidewall, and the blank further comprises a first section and a second section, the first section comprising the first bottom panel, the first end panel, and the first side panel, the second section comprising a second bottom panel, a second end panel foldably connected to the second bottom panel, and a second side panel foldably connected to the second bottom panel, the first section is for forming a first compartment comprising the first sidewall when the container is formed from the blank and the liner material, and the second section is for forming a second compartment comprising a second sidewall at least partially formed by the second end panel and the second side panel when the container is formed from the blank and the liner material.

29. The combination of claim 28, wherein the first section and the second section are connected along a divider wall, the divider wall comprising at least a portion of at least one of the first end panel and the first side panel and at least a portion of at least one of the second end panel and the second side panel.

30. The combination of claim 28, wherein the blank further comprises a central flange portion for forming at least a portion of the flange of the container formed from the blank and the liner material, at least one of the first end panel and the first side panel is foldably connected to the central flange portion, and at least one of the second end panel and the second side panel is foldably connected to the central flange portion so that the first section and the second section are connected by at least the central flange portion.

31. A method of forming a container, the method comprising:

obtaining a blank and a liner material, the blank comprising a bottom panel, an end panel foldably connected to the bottom panel, a side panel foldably connected to the bottom panel, a first flange portion extending from the end panel, and a second flange portion extending from the side panel, wherein the end panel comprises a first lower edge extending from the bottom panel to the intermediate fold line and a first upper edge extending from the intermediate fold line to the first flange portion, the side panel comprises a second lower edge extending from the bottom panel to the intermediate fold line and a second upper edge extending from the intermediate fold line to the second flange portion;

forming the blank into an initial construct comprising folding the end panel and the side panel relative to the bottom panel so that the first lower edge and the first upper edge abut the respective second lower edge and second upper edge at a corner of the container and forming the first flange portion and the second flange portion into a flange;

attaching at least a portion of the liner material to an inner surface of the initial construct so that the liner material and the initial construct form a respective liner and base layer of the container and so that the liner is releasably attached to the inner surface of the base layer by the heat seal layer, wherein the liner is separable from the base layer after heating the container;

wherein the end panel and the side panel at least partially form a sidewall, the flange extending outwardly from the sidewall, the sidewall comprising a lower portion extending along the bottom panel and an upper portion extending upwardly from the lower portion along an intermediate fold line, wherein the lower portion is oblique with respect to the bottom panel, the upper portion is oblique with respect to the lower portion, and the upper portion extends at an obtuse angle from the lower portion along the inner surface.

32. The method of claim 31, wherein the forming the initial construct comprises folding the end panel and the side panel with respect to the bottom panel so that the lower portion of the sidewall extends upwardly and outwardly from the bottom panel, the lower portion extends at a first angle with respect to the bottom panel, the upper portion extends at a second angle with respect to the lower portion, and each of the first angle and the second angle is obtuse.

33. The method of claim 32, wherein the attaching at least a portion of the liner material to the initial construct comprises releasably attaching the liner to the base layer along at least a portion of each of the bottom panel, the lower portion of the sidewall, and upper portion of the sidewall.

34. The method of claim 31, wherein the first lower edge extends at a first angle with respect to the second lower edge in the blank, the first upper edge extends at a second angle with respect to the second upper edge in the blank, and the first angle is different than the second angle.

35. The method of claim 34, wherein the second angle is larger than the first angle.

36. The method of claim 34, wherein the obtuse angle is a second obtuse angle, the first angle and the second angle are configured so that the lower portion of the sidewall extends at a first obtuse angle with respect to the bottom panel and the upper portion of the sidewall extends at the second obtuse angle with respect to the lower portion of the sidewall after the forming the initial construct.

37. The method of claim 31, wherein the bottom panel is a first bottom panel and the sidewall is a first sidewall, and the forming the initial construct comprises forming a first compartment comprising the first bottom panel and the first sidewall and forming a second compartment comprising a second bottom panel and a second sidewall extending along the second bottom panel, the first compartment and the second compartment being connected along a divider wall comprising at least a portion of each of the first sidewall and the second sidewall.

38. The method of claim 37, wherein the lower portion, the upper portion, and the intermediate fold line of the first sidewall are a first lower portion, a first upper portion, and a first intermediate fold line, respectively, the second sidewall comprises a second lower portion extending along the second bottom panel and a second upper portion extending upwardly from the second lower portion along a second intermediate fold line, each of the first lower portion and the second lower portion extends at a first obtuse angle with respect to the respective first bottom panel and second bottom panel, and each of the first upper portion and the second upper portion extends at a second obtuse angle with respect to the respective first lower portion and second lower portion.

* * * * *